US006923751B2

(12) United States Patent
Oxford

(10) Patent No.: US 6,923,751 B2
(45) **Date of Patent: *Aug. 2, 2005**

(54) ANKLE, LEG AND HIP EXERCISING DEVICE

(76) Inventor: Stuart G. Oxford, 13616 N. 78th St., Omaha, NE (US) 68122

( * ) Notice: Subject to any disclaimer, the term of this patent is extended or adjusted under 35 U.S.C. 154(b) by 603 days.

This patent is subject to a terminal disclaimer.

(21) Appl. No.: 09/772,029

(22) Filed: Jan. 29, 2001

(65) Prior Publication Data

US 2001/0005706 A1 Jun. 28, 2001

Related U.S. Application Data

(63) Continuation of application No. 09/216,782, filed on Dec. 18, 1998, now Pat. No. 6,238,325.

(51) Int. Cl.[7] ..... A63B 23/04; A63B 22/14
(52) U.S. Cl. ..... 482/146; 482/79
(58) Field of Search ..... 482/51–53, 57, 482/79, 80, 90, 92, 93, 146, 77, 148

(56) References Cited

U.S. PATENT DOCUMENTS

| | | | | | |
|---|---|---|---|---|---|
| 2,206,902 | A | * | 7/1940 | Kost | 601/27 |
| 3,020,046 | A | | 2/1962 | Hotas | |
| 3,923,302 | A | * | 12/1975 | Boggild | 482/33 |
| 4,337,939 | A | * | 7/1982 | Hoyle et al. | 482/79 |
| 4,605,220 | A | | 8/1986 | Troxel | 272/96 |
| 4,653,748 | A | | 3/1987 | Seel et al. | 272/96 |
| 5,135,450 | A | * | 8/1992 | Smith, IV | 482/80 |
| 5,586,958 | A | | 12/1996 | Little | 482/79 |
| 5,685,807 | A | * | 11/1997 | Tong et al. | 482/77 |
| 5,842,483 | A | * | 12/1998 | Timko | 132/73 |
| 6,238,325 | B1 | * | 5/2001 | Oxford | |

* cited by examiner

*Primary Examiner*—Stephen R. Crow
(74) *Attorney, Agent, or Firm*—Thomte, Mazour & Niebergall; Dennis L. Thomte

(57) ABSTRACT

An ankle, leg and hip exercising device is disclosed which includes a parabolic-shaped base portion having a foot supporting and retaining portion at the upper end thereof. A plurality of pipe stubs are secured to the device which are adapted to receive weight supports thereon. At least one of the upstanding pipe stubs is designed to have a flexible tubular member positioned therein which extends upwardly therefrom so that the user may either resist the movement of the device in any of its 360° permissible movements, and also enables the user to cause the movement of the device in any of its 360° movements. The foot of the user is securely received in a recessed portion of the foot supporting and retaining portion to positively maintain the user's foot in the proper position. The device of this invention may be used while either sitting, reclining or standing.

17 Claims, 6 Drawing Sheets

ANKLE, LEG AND HIP EXERCISING DEVICE

CROSS-REFERENCE TO RELATED APPLICATION

This is a continuation application of Petitioner's earlier application Ser. No. 09/216,782 filed Dec. 18, 1998 now U.S. Pat. No. 6,238,325, entitled AN ANKLE, LEG AND HIP EXERCISING DEVICE.

BACKGROUND OF THE INVENTION

1. Field of the Invention

This invention relates to an exercising device and more particularly to an ankle, leg and hip exercising device.

2. Description of the Related Art

Many types of ankle exercising devices have been previously provided which are designed to enable a person to exercise his/her ankle in an effort to rehabilitate the same. Heretofore, most of the prior art ankle exercising devices only enabled the ankle to be exercised in a fore and aft manner and not in a side-to-side manner. Further, the prior art ankle exercising devices do not have any means associated therewith for increasing or decreasing the resistance of movement to the ankle in a 360° motion. Additionally, the prior art devices do not include any mechanism whereby the person could actually assist the movement of the person's ankle by means other than flexing of the ankle. Additionally, the prior art devices are not believed to have the capability of permitting the ankle to be exercised while the person is standing, sitting or reclining. Yet another disadvantage of the prior art devices is that they are not believed to have the capability of permitting the exercising of the ankle, leg and hip.

SUMMARY OF THE INVENTION

An ankle, leg and hip exercising device is disclosed comprising a lower portion having an upper and a parabolic-shaped lower end whereby the lower end may be selectively positioned on a supporting surface so as to have a full range of movement with respect thereto. A foot supporting and retaining portion is provided at the upper end of the lower portion for supporting and retaining a person's foot therein. At least one exercise attachment receiving means is provided on the foot supporting and retaining portion and preferably includes a means for receiving a weight thereon. Further, the exercise attachment receiving means comprises an upstanding pipe stub adapted to have a first elongated tubular member, having upper and lower ends, having its lower end received by the pipe stub and extending upwardly therefrom. The upper end of the tubular member has a first grip portion thereon to enable the person using the device to either move the device to flex the ankle or to create resistance to the flexing of the ankle. When additional resistance is required, a second tubular member may be slipped over the first tubular member to increase the rigidity thereof. In the preferred embodiment, the foot supporting and retaining portion is selectively removably secured to the lower portion and includes a recessed portion which receives the foot of the person utilizing the device. A heel retainer is also adjustably positioned over the U-shaped member which extends over the forward portion of the person's foot.

OBJECTS OF THE INVENTION

It is principal object of this invention to provide an ankle exercising device.

Yet another object of the invention is to provide an ankle, leg and hip exercising device.

Yet another object of the invention is to provide an ankle, leg and hip exercising device which includes a parabolic-shaped member which engages a supporting surface to enable the device to be moved in a 360° manner.

Still another object of the invention is to provide an ankle, leg and hip exercising device which securely positions the user's foot therein.

Yet another object of the invention is to provide an ankle, leg and hip exercising device including a heel retaining means.

Yet another object of the invention is to provide an ankle, leg and hip exercising device including exercise attachment receiving means mounted thereon.

Yet another object of the invention is to provide an ankle, leg and hip exercising device including an upwardly extending tubular member having a hand grip on the upper end thereof which enables the user to resist the movement of the device or to cause movement of the device.

Still another object of the invention is to provide an ankle, leg and hip exercising device which may be used while standing, sitting or reclining.

Still another object of the invention is to provide an ankle, leg and hip exercising device including means for supporting weights thereon so that the weights may be positioned at different angles with respect to the ankle.

Still another object of the invention is to provide an ankle, leg and hip exercising device which permits the ankle to be exercised in a 360° manner.

Still another object of the invention is to provide an ankle, leg and hip exercising device which is conveniently attached to the user's foot.

These and other objects will be obvious to those skilled in the art.

DESCRIPTION OF THE PREFERRED EMBODIMENT

Figure 1:
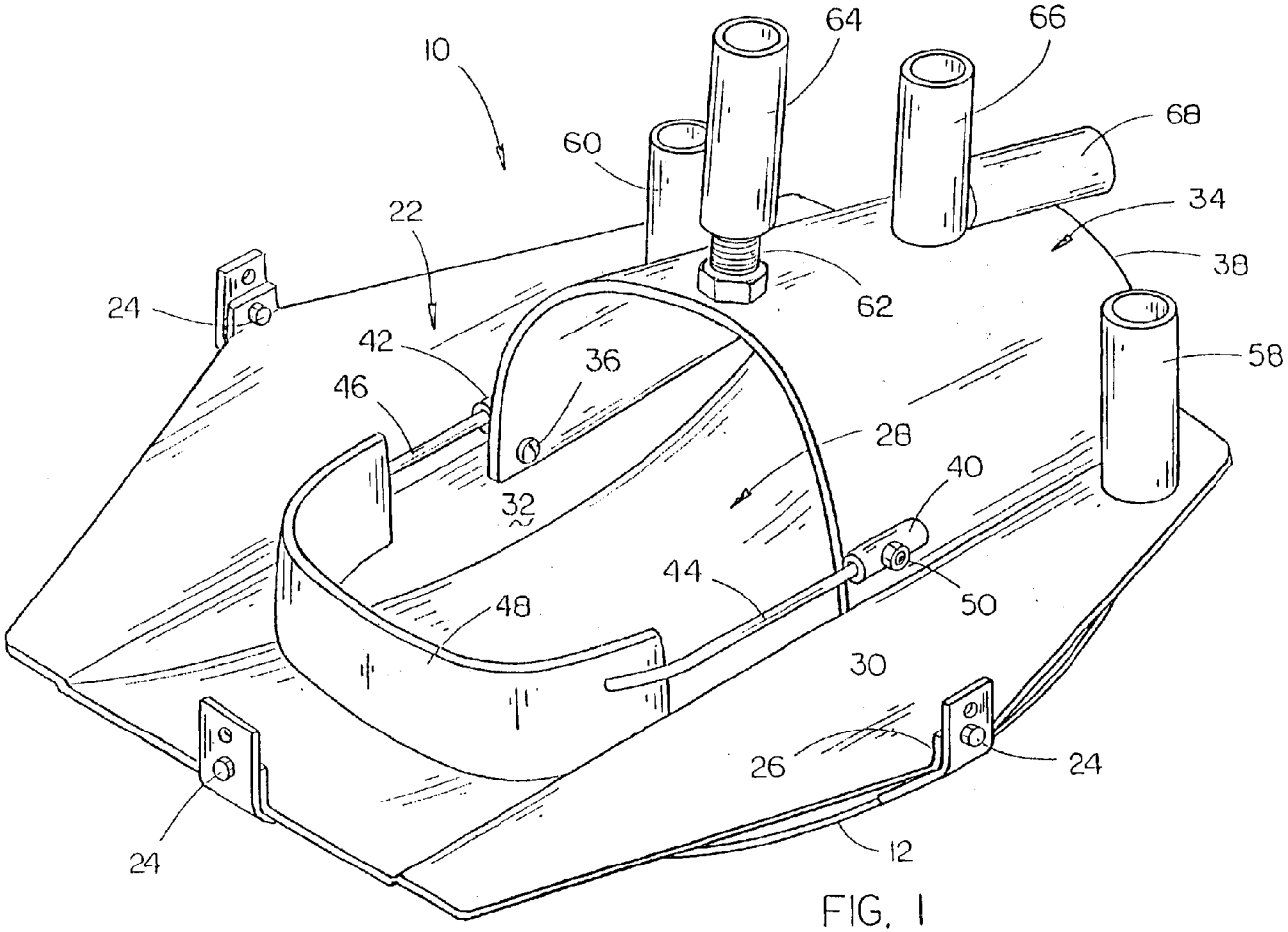
FIG. 1 is a rear perspective view of the device of this invention.
Figure 2:
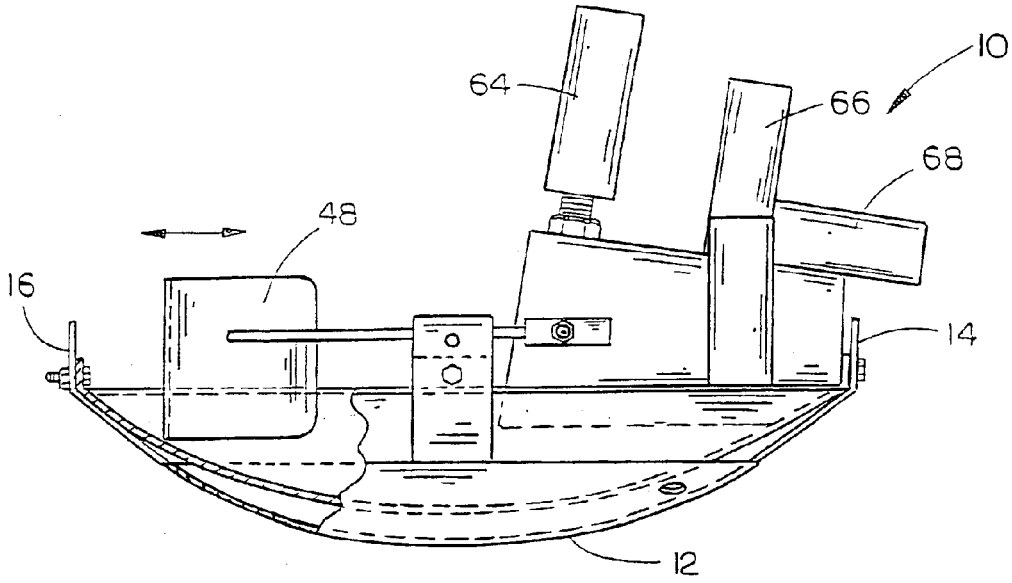
FIG. 2 is a side elevational view of the device with portions thereof cut away to more fully illustrate the invention.
Figure 3:
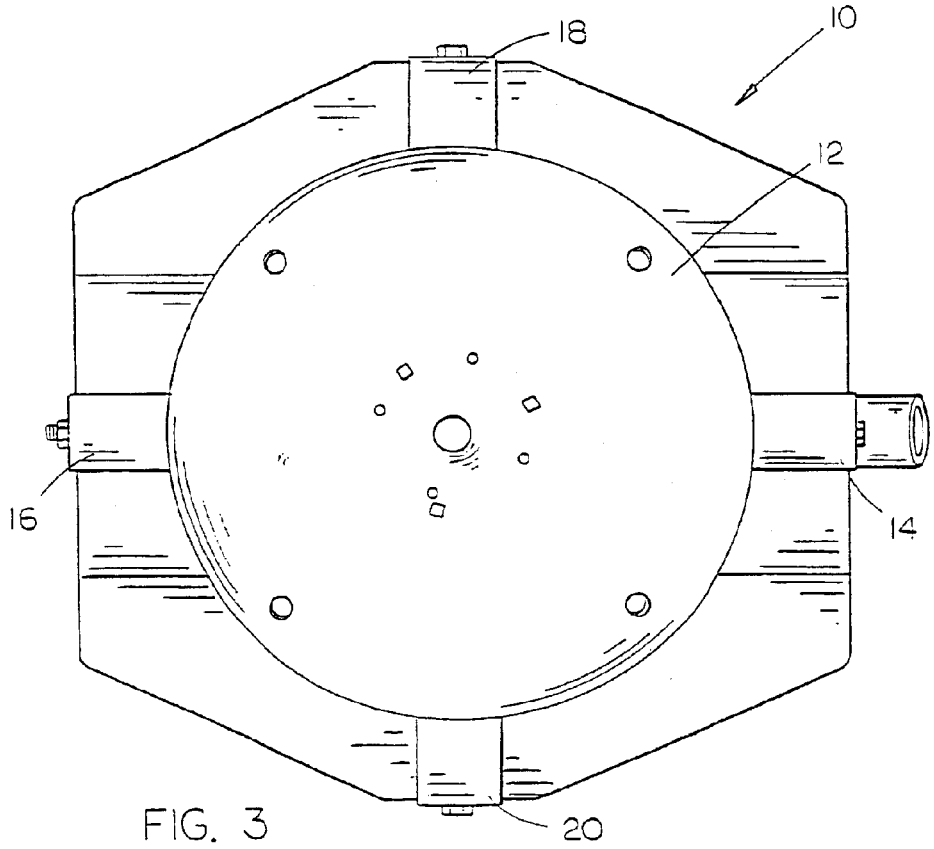
FIG. 3 is a bottom view of the device.

The ankle, leg and hip exercising device of this invention is referred to generally by the reference numeral 10 and includes a lower parabolic-shaped base portion 12 having an upstanding bracket 14 at its forward end, an upstanding bracket 16 at its rearward end, and upstanding brackets 18 and 20 at its opposite sides. A foot supporting and receiving mantle 22 is positioned on and secured to the base portion 12 by means of bolts or screws 24 extending through the brackets 14, 16, 18 and 20 and the upstanding brackets 26 extending upwardly from the rearward and forward ends and the opposite sides of the foot receiving and supporting portion 22. Foot supporting and receiving portion 22 is provided with a recessed area 28 defined by side walls 30 and 32 adapted to receive the foot of the user. An inverted U-shaped member 34 is secured to the side walls 30 and 32 by screws or bolts 36 and extends upwardly therefrom. As seen in the drawings, the U-shaped member 34 tapers from its rearward end to its forward end and has an open forward end 38. A pair of collars 40 and 42 are secured to the sides of the U-shaped member 34 and are adapted to receive rods 44 and 46 therein which extend forwardly from a heel retaining member 48. The position of the heel retaining portion 48 is selectively adjustable with respect to the collars 40 and 42 by means of set screws 50 extend into the collars 40 and 42 and which engage the rods 44 and 46. The rigid rods 44 and 46 and the heel retaining portion 48 may be replaced by an elastic strap 52 having hooks 54 and 56 secured to the opposite ends thereof which may be attached to the collars 40 and 42, respectively. Preferably, the forward surface of the heel retaining portion 48 and the interior surface of the U-shaped member 34 is lined with a foam cushioning material.

A pair of exercise attachment pipe stubs 58 and 60 are secured to the foot receiving and supporting mantle 22 at the opposite forward ends thereof and are adapted to receive exercise devices as will be described hereinafter. A threaded stud 62 is secured to the upper portion of the U-shaped member 34 and extends upwardly therefrom and has a threaded pipe stub 64 threadably mounted thereon. A pipe stub 66 is also secured to the upper surface of the U-shaped member 34 and extends upwardly therefrom, as illustrated in FIG. 1. Additionally, a horizontally extending pipe stub 68 is secured to the upper portion of the U-shaped member 34 and extends forwardly therefrom.

Figure 4:
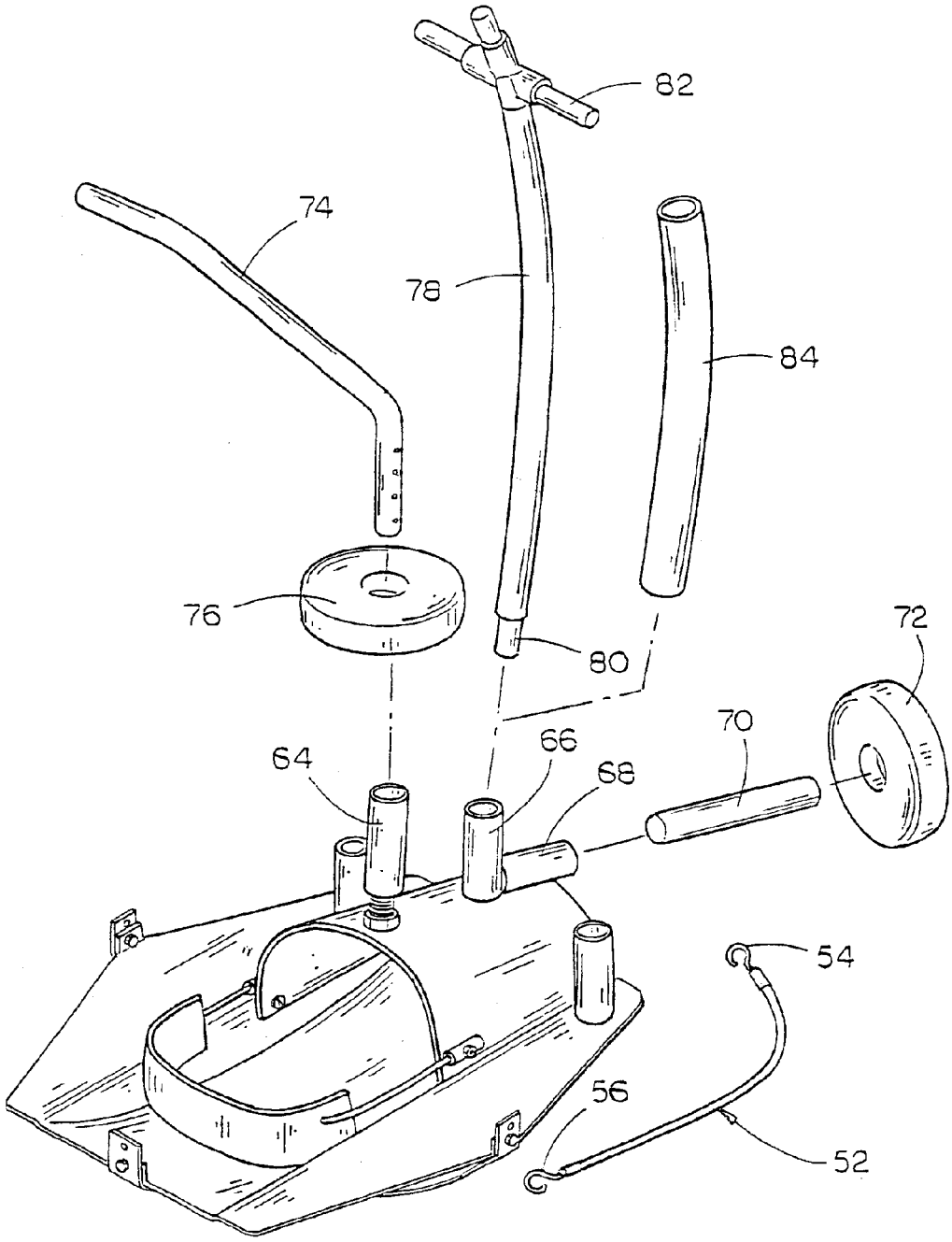
FIG. 4 is a perspective view of the device illustrating the manner in which attachments may be secured thereto.
Figure 5:
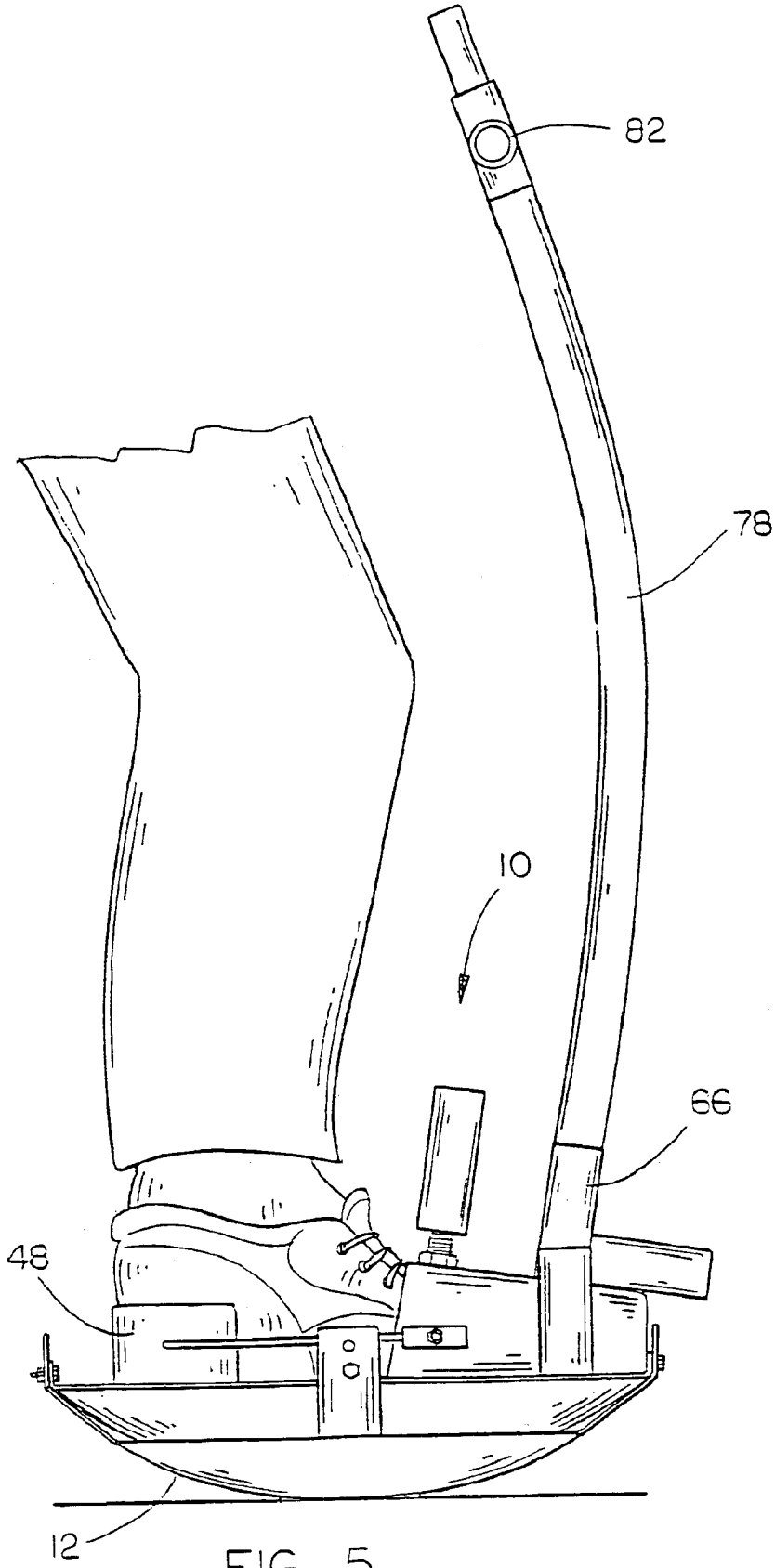
FIG. 5 is a side view illustrating a person's foot positioned in the device.
Figure 6:
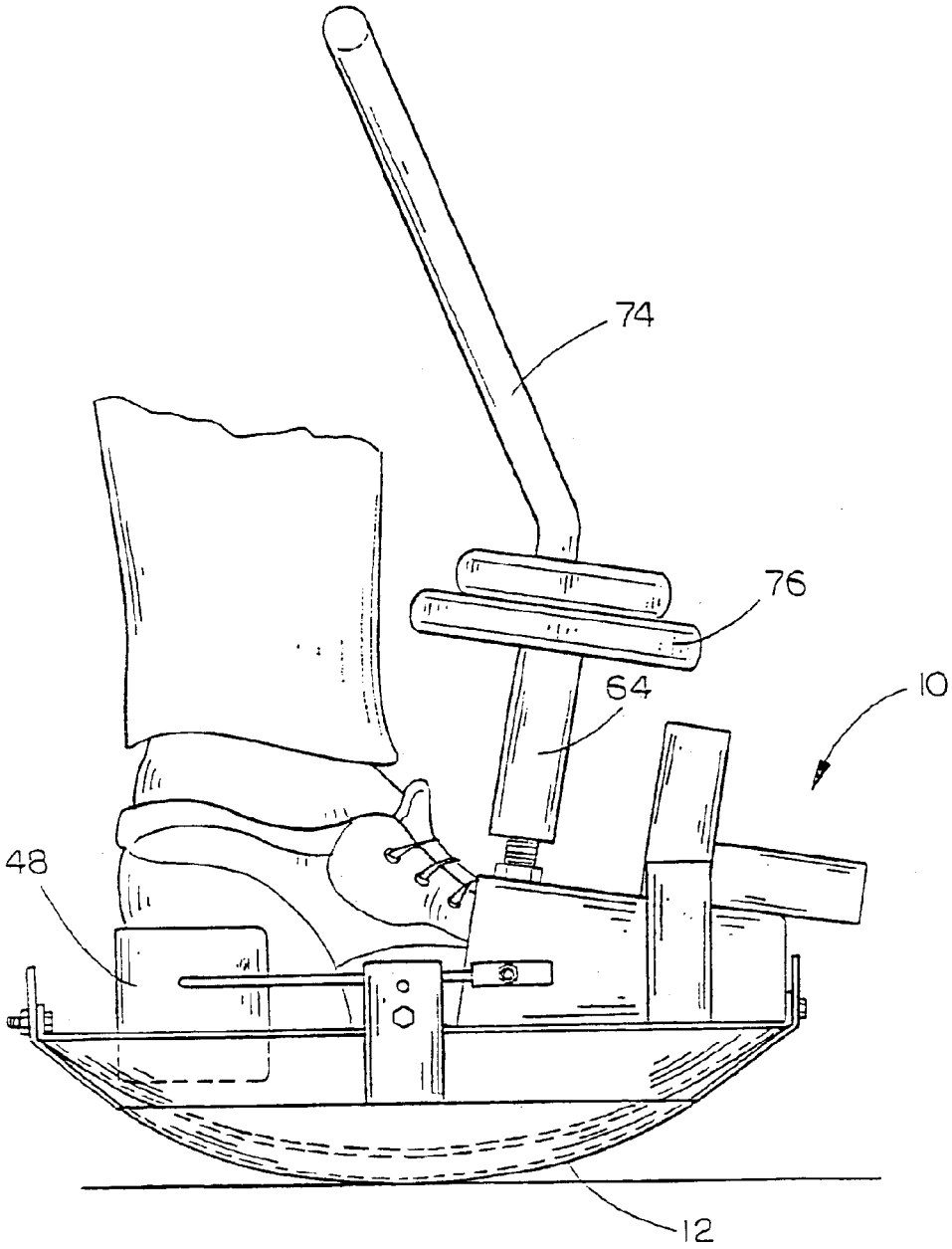
FIG. 6 is a view similar to FIG. 5 except that a different attachment has been secured thereto.
Figure 7:
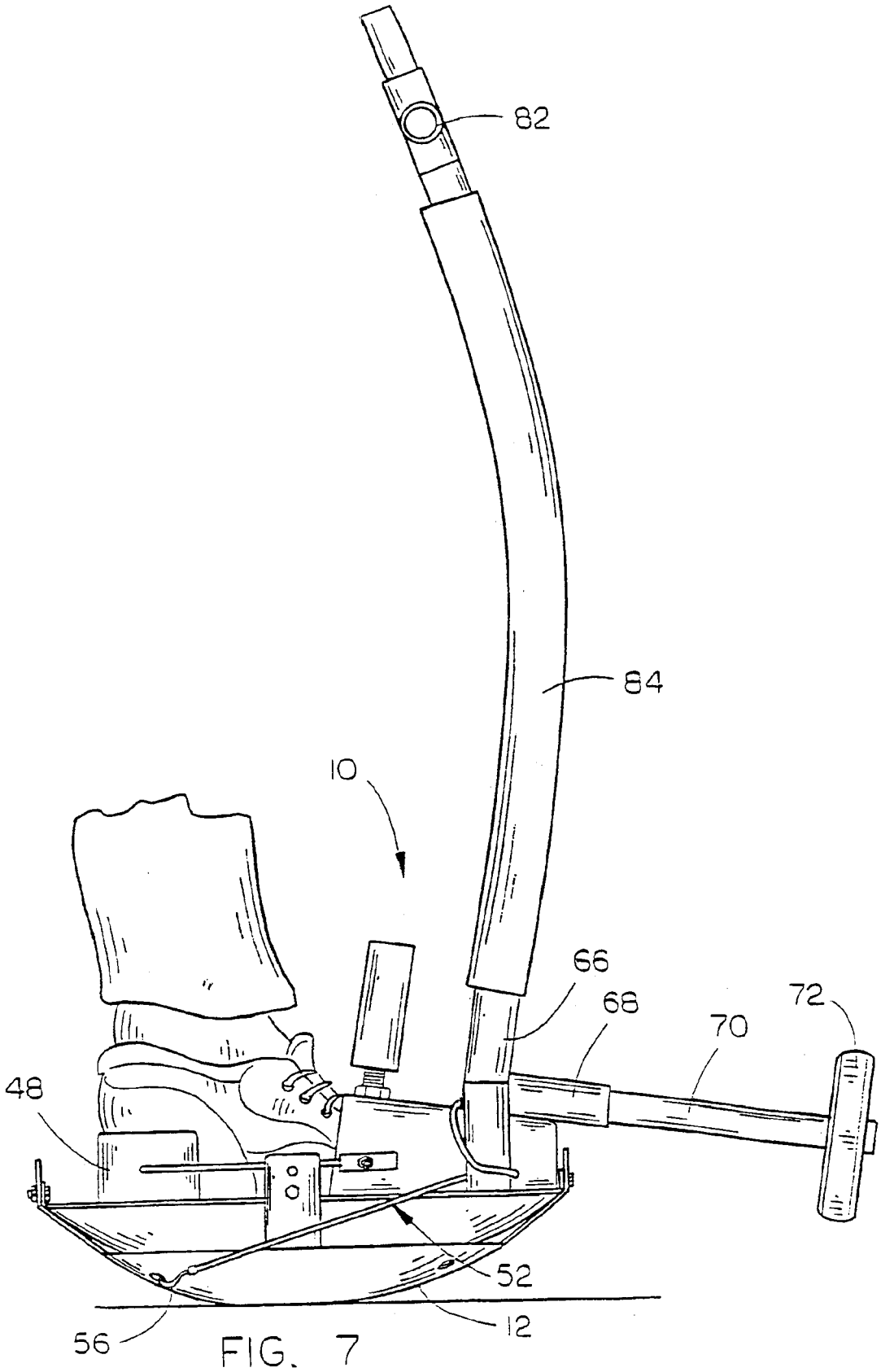
FIG. 7 is a view similar to FIGS. 5 and 6 except that a weight has been secured to the device which is positioned forwardly of the device.

The pipe stubs 58, 60, 64, 66 and 68 are designed to receive various devices. As illustrated in FIG. 4, pipe stub 68 is adapted to receiving a shaft or rod 70 therein adapted to have a circular weight 72 mounted thereon to increase the resistance of the upward movement of the forward end of the device during exercising. Pipe stub 64 is adapted to receive the lower end of a handle-like member 74 therein which is adapted to support a weight 76 thereon. The handle member 74 may be manually grasped by the user of the device to either move the device in any of its 360° motions or to resist the movement of the device in any of its 360° motions.

The numeral 78 refers to a flexible tubular member having its lower end 80 adapted to be inserted in the pipe stub 66, as illustrated in FIG. 4, and which has a handle 82 at its upper end. The tubular member 78, when mounted in the pipe stub 66, enables the user to resist the movement of the device or to move the device. When it is desired to increase the resistance of the tubular member 78, a larger tubular member 84 is slipped over tubular member 78 which decreases the flexibility of the member 78.

It can therefore be seen that an ankle, leg and hip exercising device has been provided which enables exercise of the particular portion of the user's body in any of 360° motions. The device includes means for positioning weights on the device at either the forward end, opposite sides or at the upper portion thereof to provide the proper resistive motion to the device. Further, the device is able to be used while either sitting, standing or reclining. Additionally, the use of the members 74 or 78 enables the user to either assist in the movement of the ankle or to resist movement of the ankle.

Thus it can be seen that the invention accomplishes at least all of its stated objectives.

I claim:

1. An ankle, leg and hip exercising device, comprising:

a lower portion having an upper end and a substantially rigid parabolic-shaped lower end whereby said lower end may be selectively movably positioned on a supporting surface so as to have a full range of movement with respect thereto;

said upper end of said lower portion having an elongated recessed area formed therein; said recessed area being defined by a forward end, a rearward end and generally vertical opposite side walls; and a foot supporting and retaining portion operatively secured to said opposite side walls of said elongated recessed area for maintaining a person's foot in said recessed area and resisting the upward, transverse, and longitudinal motion of the person's foot with respect to the device.

2. The device of claim 1 wherein at least one exercise attachment means is provided on said foot supporting and retaining portion.

3. The device of claim 2 wherein said exercise attachment means has a receiving means for receiving a weight means thereon.

4. The device of claim 3 wherein said receiving means comprises an upstanding pipe stub.

5. The device of claim 4 wherein a first elongated tubular member, having upper and lower ends, has its lower end received by said pipe stub and extends upwardly therefrom.

6. The device of claim 5 wherein the upper end of said first tubular member has a hand grip portion thereon.

7. The device of claim 6 wherein said first tubular member has weights mounted thereon.

8. The device of claim 5 wherein said elongated tubular member is comprised of a flexible material.

9. The device of claim 4 wherein a plurality of overlapping tubular members are secured to said pipe stub and extend upwardly therefrom.

10. The device of claim 2 wherein a plurality of exercise attachment receiving means are provided on said foot supporting and retaining portion.

11. The device of claim 10 wherein each of said exercise attachment receiving means comprises a pipe stub.

12. The device of claim 10 wherein said foot supporting and retaining portion has a forward end, a rearward end, and opposite sides and wherein a pipe stub extends upwardly from said foot supporting and retaining portion at its forward end and at each of its sides adjacent the forward end thereof.

13. The device of claim 12 wherein a horizontally extending pipe stub extends forwardly from the pipe stub located at the forward end of said foot supporting and retaining portion.

14. The device of claim 12 wherein a pipe stub extends upwardly from said foot supporting and retaining portion rearwardly of the pipe stub located at the forward end thereof.

15. The device of claim 1 wherein said foot supporting and retaining portion is selectively removably secured to said lower portion.

16. The device of claim 14 wherein said pipe stub which extends upwardly from said foot supporting and retaining portion rearwardly of the pipe stub located at the forward end thereof is selectively removable.

17. An ankle, leg and hip exercising device, comprising:

a lower portion having an upper end and a parabolic-shaped lower end whereby said lower end may be selectively movably positioned on a supporting surface so as to have a full range of movement with respect thereto;

a foot supporting and retaining portion at the said upper end of said lower portion for supporting a person's foot therein and resisting the upward, transverse, and longitudinal motion of the person's foot with respect to the device;

at least one exercise attachment means being provided on said foot supporting and retaining portion; said exercise attachment means having a receiving means for receiving a weight means thereon; said receiving means comprising an upstanding pipe stub;

a first elongated tubular member, having upper and lower ends, having its lower end received by said pipe stub and extending upwardly therefrom; said first elongated tubular member being comprised of a flexible material; and a second elongated tubular member selectively embracing said first elongated tubular member, thereby increasing the rigidity of said first elongated tubular member.

* * * * *